United States Patent [19]

Schmitt

[11] 4,046,419

[45] Sept. 6, 1977

[54] SWIVEL CHAIR

[76] Inventor: Karl Schmitt, Rangstrasse 39, 64 Fulda, Germany

[21] Appl. No.: 676,680

[22] Filed: Apr. 14, 1976

[30] Foreign Application Priority Data

Apr. 21, 1975 Germany ..... 2517578

[51] Int. Cl.[2] ..... A47B 83/02

[52] U.S. Cl. ..... 297/153; 248/429; 297/328; 297/344; 297/417; 297/432

[58] Field of Search ..... 297/143, 153, 174, 326, 297/328, 344, 410, 417, 423, 429, 432, 436; 248/376, 384, 416, 424, 425, 429; 108/9, 48, 77, 79, 80; 200/86.5

[56] References Cited

U.S. PATENT DOCUMENTS

| | | | |
|---|---|---|---|
| 222,092 | 11/1879 | Starr | 297/410 X |
| 585,913 | 7/1897 | Haynes | 297/414 |
| 1,952,768 | 3/1934 | McGowen | 297/344 |
| 2,375,696 | 5/1945 | Shick | 297/174 X |
| 2,553,652 | 5/1951 | Gradle et al. | 297/344 X |
| 2,592,025 | 4/1952 | Gray | 297/429 X |
| 2,748,835 | 6/1956 | Barecki | 297/328 X |
| 2,850,077 | 9/1958 | Dawson | 297/429 X |
| 3,480,249 | 11/1969 | Lie | 297/328 X |
| 3,774,965 | 11/1973 | Brandt et al. | 297/417 |
| 3,980,848 | 9/1976 | Schulz et al. | 200/86.5 |

FOREIGN PATENT DOCUMENTS

| | | | |
|---|---|---|---|
| 388,733 | 7/1922 | Germany | 297/143 |
| 763,666 | 5/1955 | Germany | 297/326 |
| 342,662 | 8/1936 | Italy | 297/174 |
| 374,221 | 6/1932 | United Kingdom | 297/153 |

*Primary Examiner*—Roy D. Frazier
*Assistant Examiner*—William E. Lyddane
*Attorney, Agent, or Firm*—Hill, Gross, Simpson, Van Santen, Steadman, Chiara & Simpson

[57] ABSTRACT

A chair is rotatable and rockable, has an adjustable headrest and arm and leg rests selectively pivotable into use positions, and is carried for forward and backwards movement upon a baseplate attached at a forward end thereof to a work station fixture such as a desk or work table. The chair has an undercarriage with two rollers and a guide bar forming a "T." The base T is guided in longitudinal movement by a guide tube with which the guide bar is telescopic and by raised longitudinal edges along the base plate cooperating with the rollers of the undercarriage.

11 Claims, 5 Drawing Figures

SWIVEL CHAIR

BACKGROUND OF THE INVENTION

1. Field of the Invention

The invention relates to chairs which are rotatable, rockable, and translationally moveable at a work station.

2. The Prior Art

Conventional swivel chairs have undercarriages with four or more radially-extending arms each of which carries a caster wheel on the outer end thereof. The casters are not interconnected directionally, so before the chair can be freely moved translationally, effort must be expended to align the axis of rotation of the wheels. Reduction of caster width reduces the forces necessary to align the casters initially, but increases bearing pressures of the casters upon the floor. Substantial wear upon and damage to the floor, especially where carpeting is used, is experienced. Small rollers or casters are unable to roll over carpet edges.

Swivel chairs also usually have fixed arm rests which, however, hinder the user's work performance as often as they assist in the work by permitting a resting of the arms. Further, fixed arms may interfere with motions into and out of the swivel chair, particularly for handicapped persons.

SUMMARY OF THE INVENTION

An undercarriage of a swivel chair is arranged to travel upon a baseplate having an elongated rectangular shape and resting upon the floor. The undercarriage is moved back and forth in the longitudinal direction upon two transversely-spaced rollers and with a guide bar which prevents tilting of the chair. The baseplate is attached to the desk, drawing table, or other work station where the chair is to be used. An adjustable, telescoping column is affixed to the undercarriage and extends upwardly through a vertical adjustment and pivot bearing point to a pivot bar engaging the undersurface of the chair seat. The pivot bar allows the chair to rock within safe ranges forwardly and backwardly. An adjustable head rest is provided on a backrest of the chair. Arm rests are selectively pivotable into a use position and out of the way when not needed. Each arm contains a telescoping end extension portion adapted to receive a small work board directly thereon. A leg rest is pivoted to the front of the chair, and is held either folded out of the way beneath the chair or upwardly, in a rest position, by a leg attached to the underside of the leg support platform. At the front of the baseplate, beneath the working surface, is an inclined foot rest plate which may be fitted with foot-actuated switches and electric outlets for supply and control of energy to machinery operated at the work station.

DESCRIPTION OF THE PREFERRED EMBODIMENTS

Figure 1:
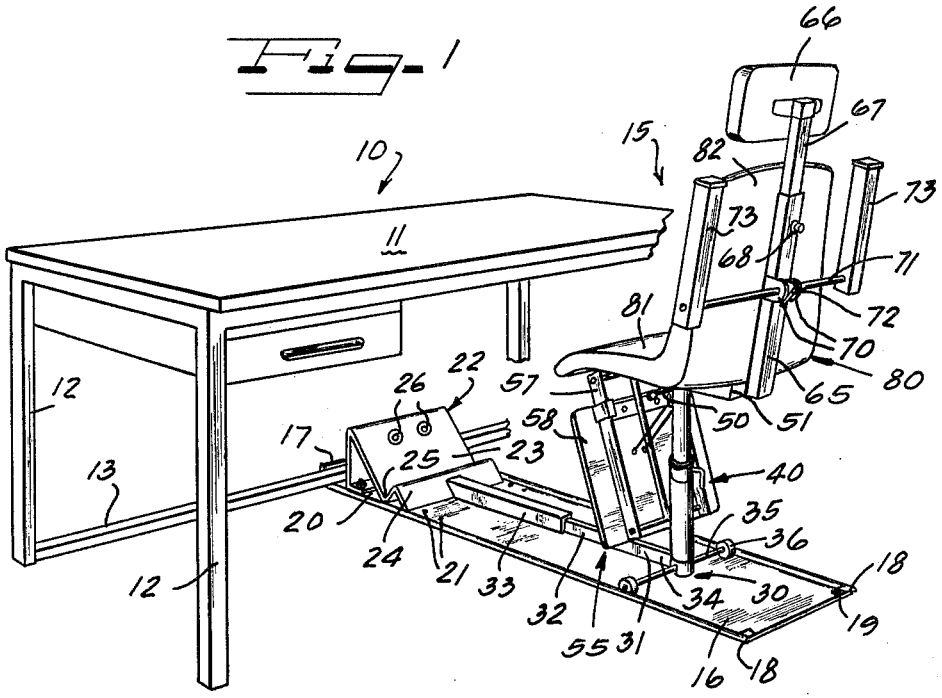
FIG. 1 is a general perspective view of the invention.

The swivel chair of the present invention is adapted for use as shown in FIG. 1 at a work station such as a desk 10 having a work surface 11 beneath which a worker's legs and feet may extend. The work surface 11 is supported upon legs 12, and a traverse bar 13 extends along the rear lower portion of the work station fixture 10.

In accordance with the principles of the invention, a swivel chair 15 to be used with the work station fixture 10 is translationally moveable upon an elongated baseplate 16. The baseplate 16 extends beneath the work table surface 11 and has an upturned end 17 which is captured behind the transverse bar 13 of the fixture 10. The baseplate 16 lies flat upon a floor surface and is preferably formed of a hard material such as steel which can receive and spread concentrated loads placed thereupon. Each longitudinal edge of the base plate 16 is raised as at 18, 18 to form rails or edges to constrain movement of the chair 15. Transversely-extending stop members 19 may be fitted upon the base plate 16 at the rear edges thereof.

A front end 20 of the baseplate 16 is formed with a plurality of longitudinally-spaced aperatures 21 to which may be bolted a foot rest device 22 having an inclined front surface 23 for resting a user's feet flatly thereupon. An upturned ridge 24 below the front surface 23 forms a trough 25 into which may be received a user's heels to give an improved grasp upon the ground surface. The ridge 24 and trough 25 are especially useful if foot switches 26 are used at the work station 10, since then the user must have a means of applying downward pressure on the switches 26 without thereupon rolling away from the work station. Electricity is provided to the switches 26 and to general-purpose outlets 27 by a single cable 28, simplifying installation.

The chair 15 is longitudinally moveable along the baseplate 16 upon an undercarriage 30 formed generally in a T. A rectangular guide bar 31 forms the base of the T of the undercarriage 30 and extends longitudinally of the baseplate 16 midway between the side edges 18. A forward end 32 of the guide bar 31 is received in a guide bar tube 33 which is affixed to the base plate 16 rearwardly of the footrest assembly 22. The guide bar 31 and the guide bar tube 33 are each rectangular in form to avoid twisting therebetween. It is desireable to apply rectangular bearings between the moving portions, so that thrust loads may be accepted smoothly without binding between the parts.

A rear portion 34 of the guide bar 31 is affixed to a transverse axle 35 which extends from one side edge 18 of the baseplate 16 to the other. Rotatable rollers 36 are mounted on each end of the axle 35 to provide rotational bearing between the undercarriage 30 and the baseplate 16. The rollers 36 may be of a hard rubber or metal material to give minimal rolling resistance, since all pressure stresses are absorbed and redistributed by the material of the baseplate 16 without damage to the underlying floor surface. The rollers 36 are sufficiently small in relation to the heights of the side edges 18 and the stop members 19 to avoid any possibility of their rolling over such edges or stops. As an additional safety measure, or in lieu of the rear-end stops 19, internal stops 37 may be provided on the forward end 32 of the guide bar 31. These stops 37 are cooperable with inwardly-extending flanges on the rear end of the guide tube 33, preventing withdrawal of the guide bar 31 completely from the guide tube 33.

Figure 3:
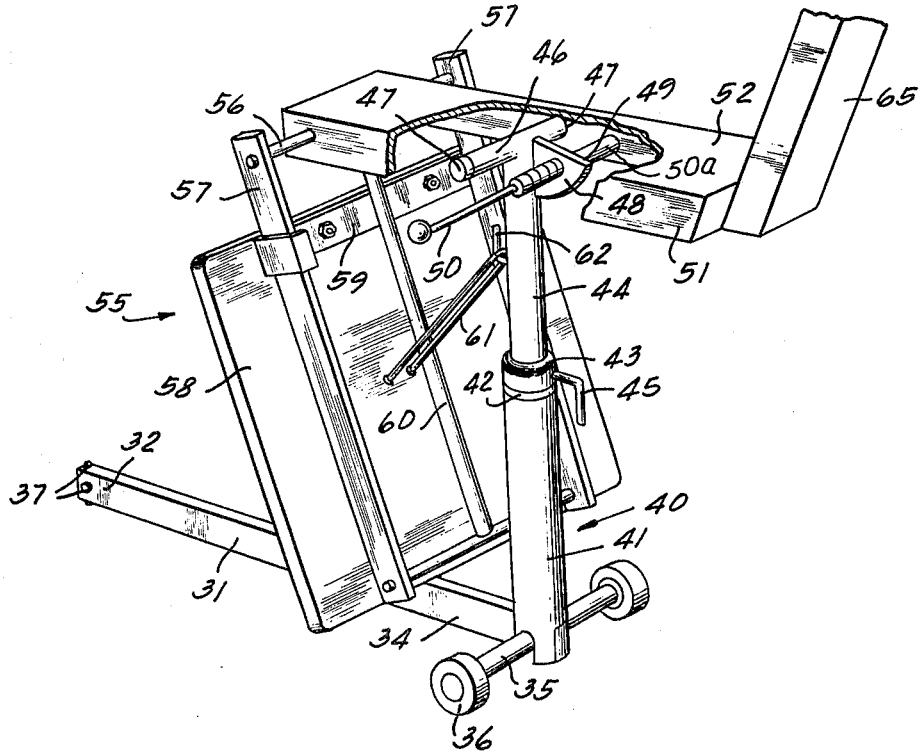
FIG. 3 is a perspective view, partially in section, of the undercarriage and seat support mechanism.
Figure 2:
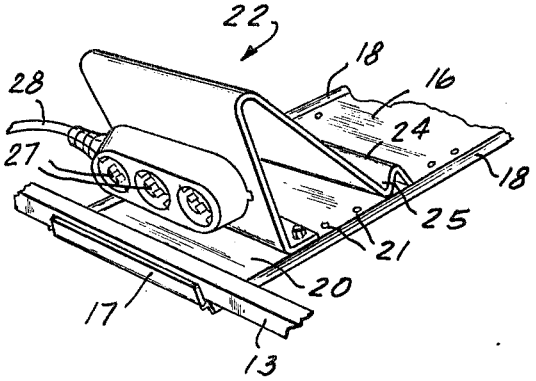
FIG. 2 is a perspective view from the front of the foot rest of the invention.

At the junction of the guide bar 31 with a transverse axle 35 of the undercarriage 30 is attached a vertical, telescopable column 40, as best shown in FIG. 3. A first, lower column 41 is welded to the rear end 34 of the guide bar 31 and to the transverse axle 35. An upper end of the lower column 41 has a bearing surface 42 upon which rides a rotatable bearing collar 43. A second column 44 is received slidably within the column 43 and is extensible into the first column 41. A screw clamp 45 in the collar 43 adjusts the vertical position of the second column 44 with respect to the lower column 41 and the second column 44 is rotatable with respect to the first column 41 via the collar 43.

The second column 44 carries on its upper end a transverse tube 46 having two ends 47. A triangular disc 48 is attached to the upper part of the column 44 transversely to the tube 26, the disc 48 having an inclined upper surface forming a rest stop 49. Fitted through the flat surface of the disc 48 is a stop lever 50 which is reciprocably moveable in a carrying tube 50*a* parallel to the transverse tube 46 and spaced therefrom as shown in FIG. 3.

A seat carrier 51 is fitted pivotally to the ends 47 of the tube 46 for rocking movement with respect to the tube 46 and column 40 in a fore and aft direction. The seat carrier 51 is rectangular in form, and a flat surface portion 52 thereof engages against the rest stop 49 when tilted backwardly. As shown in the Figure, a right end of the lever 50 engages, in a conventional manner, catch means on a surface of the seat carrier 51 in the work position of the seat ad in an inwardly-moved or rightward position of the lever 50.

Figure 4:
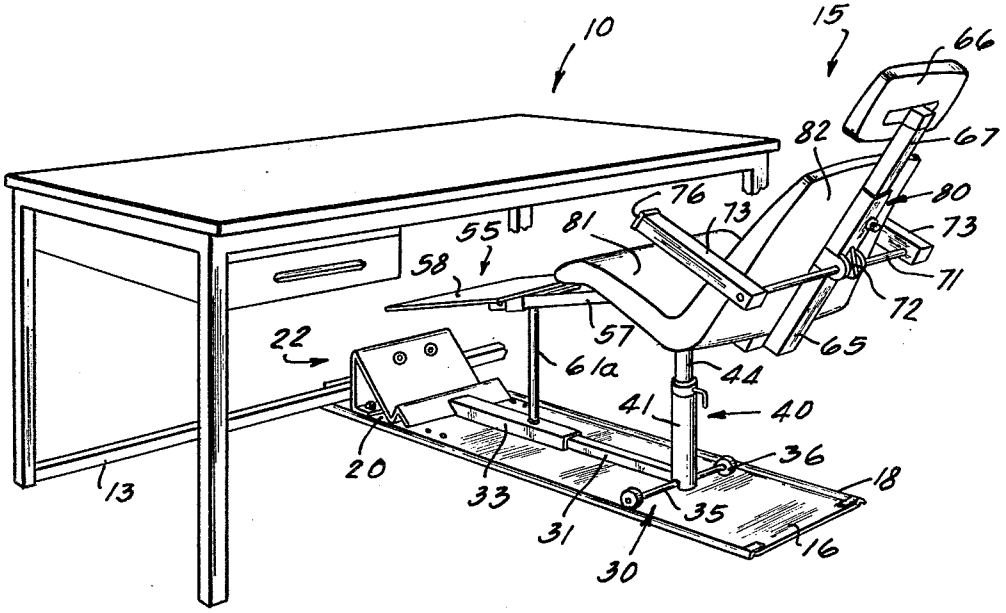
FIG. 4 is a general perspective view similar to FIG. 1 but showing the assembly in a rest position.

Attached pivotally to the front of the seat carrier 51 is a leg support assembly 55, also shown in FIG. 3. A pivot bar 56 extends through the sides of the seat carrier 51 parallel to the transverse tube 46 upon which the seat carrier 51 is mounted. A pair of spaced-apart leg support rails 57 engage ends of the pivot 56 and extend transversely thereto. A leg support plate 58 is attached to the rails 57 through a transverse bar 59. A T shaped support tube 60 extends beneath the plate 58 to align the rails 57, 57. A platform leg 61 is attached to a lower side of the leg support plate 58 and extends therefrom selectively either to a hook 62 arranged on the column 44 when the platform 58 is to be stored in a folded position engageable with the baseplate 16 or an upper surface of the guide tube 33 in an unfolded position of the assembly 55. As shown in FIG. 4, a solid leg 61a may be employed in lieu of the wire loop leg 61.

Attached to the rear of the seat carrier 51 is a guide tube 65 which supports a backrest and a headrest of the chair 15. The guide tube 65 is connected at an angle of about 100° to the upper surface 52 of the seat carrier 51 to provide an orthopedically correct and comfortable body position. As shown in FIGS. 1 and 4, a head rest pad 66 is carried on the end of a second tube 67 which is slidably received within the first or lower guide tube 65. An adjustment screw 68 controls the relative vertical position of the headrest 66 via the second tube 67 with regard to the first tube 65.

Spaced midway along the first guide tube 65 is a pair of brackets 70. The brackets 70 are spaced on opposite sides of the tube 65 and are apertured to receive therethrough an armrest pivot bar 71. A cam stop is carried on the pivot bar 71 between the two brackets 70. The ends of the bar 71 are each connected rigidly to an armrest 73 maintaining the armrests 73 spaced laterally apart from one another so that they may be folded forwardly from the storage position of FIG. 1 to the use portion of FIGS. 4 and 5. In the use position, the stop cam 72 engages a back surface of the guide tube 65, preventing the arms 73 from rotating past a position parallel to the upper surface 52 of the seat carrier 51.

Figure 5:
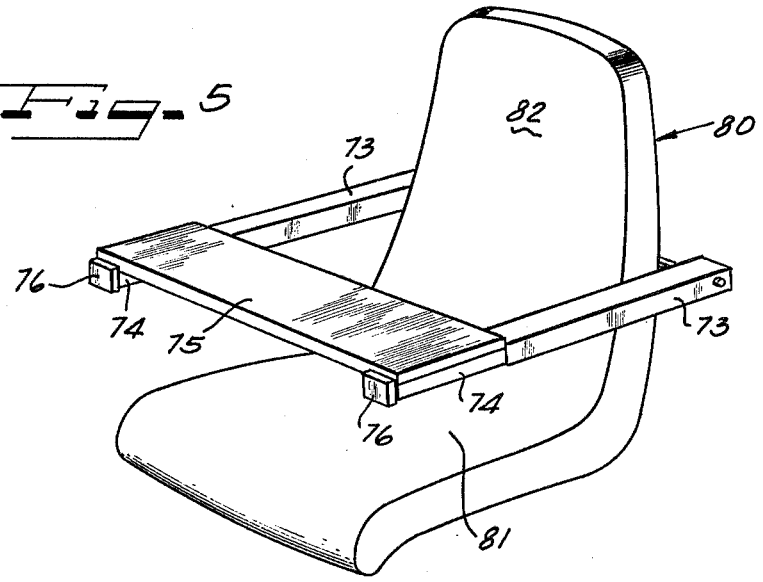
FIG. 5 is a perspective view of the seat shell and arm rests of the invention.

The arms 73 each contain a telescoping inner section 74 which may be extended as shown in FIG. 5. In the extended position, a work plate 75 may be used atop the arms 73, 74 for any desired purpose. The plate 75 is restrained upon the arm extensions 74 by end plates 76 and the forward top edges of the arm rests 73.

Finally, a seat shell 80 is received upon the seat carrier 51 and against the guide tube 65 as shown in the various figures. The shell 80 has any desired configuration including a generally horizontal seat portion 81 and a backrest portion 82.

It is anticipated that the present invention will be adaptable to many different uses, such as in filing rooms, where some of the particular structures are not necessary or may be modified to give best performance. For instance, in a filing room, long translational movements of the chair would necessitate using a four-wheeled undercarriage 30 rather than a two-wheeled undercarriage as shown in FIG. 1. In this case, two U shapes are extended from the transverse axle 35 to provide a carriage-type undercarriage. Although these and various other minor modifications may be suggested by those versed in the art, it should be understood that I wish to embody within the scope of the patent warranted hereon all such modifications reasonably and properly come within the scope of my contribution to the art.

I claim as my invention:

1. A swivel chair assembly comprising, in combination:

an elongate, flat baseplate with raised longitudinal edges and a front portion adapted to be captured beneath a horizontal traverse of a work station fixture;

a hollow, rectangular guide tube affixed longitudinally to said baseplate adjacent the front portion thereof and having an opening to the rear;

an undercarriage means for supporting said chair upon said baseplate, comprising:

a rectangular guide bar receivable telescopically on bearings in said guide tube and extending longitudinally of said baseplate, an axle portion received on a rear end of said guide bar and extending transversely of said baseplate between said raised edges thereof, and a roller received rotatably on each end of said axle portion inwardly of said raised edges of said baseplate and oriented to rotate as said undercarriage is translated along said baseplate;

first and second telescopable columns, said first column being carried on said undercarriage at the rear end of said guide bar and extending vertically therefrom, and said second column being received rotatably in said first column and being adjustable vertically with respect thereto;

chair means having a backrest portion and a seat portion carried on an upper end of said second telescopable column;

a transverse tube on an upper end of said second column, the tube having ends pivotally connected to said chair means;

said backrest portion spaced from and parallel to said transverse tube, said backrest portion including a longitudinal tube affixed thereto and a pivotable axle transversely connected thereto; and said axle having stop means limiting its pivotable orientation and carrying an armrest on either end thereof for selective storage in a substantially vertical position and use in a forwardly-pivoted position parallel to said seat portion of said chair means.

2. A swivel chair assembly as defined in claim 1, further comprising an inclined footrest plate affixed to said front portion of the baseplate forwardly of said guide tube.

3. A swivel chair assembly as defined in claim 2, wherein said footrest has foot-operable electrical switches on its upper surface for actuation by a user of the chair.

4. A swivel chair assembly as defined in claim 1, wherein the guide bar and the guide tube have cooperating stop means to prevent withdrawal of said bar from said tube.

5. A swivel chair assembly as defined in claim 1, wherein a rear end of said baseplate has stop bars extending inwardly adjacent said raised edges to stop rearward motion of said rollers and undercarriage prior to disengagement of said guide bar from said guide tube.

6. A swivel chair assembly as defined in claim 1, said chair further having a locking means mounted upon said second column to secure said chair means selectively in a non-rocking work position.

7. A swivel chair assembly as defined in claim 6, wherein said locking means comprises a bar supported in a locking bar bracket for reciprocable movement parallel to said transverse tube and spaced therefrom and selectively engageable with a catch means, said catch means being located on said chair means spaced from said transverse tube.

8. A swivel chair assembly as defined in claim 1, further comprising:

a pair of rails extending normally to said transverse tube spaced laterally apart, and pivotally connected at first ends thereof to said chair means along an axis parallel to said transverse tube;

a leg support plate attached to said rails and extending thereover; and a platform leg attached to a lower side of said plate and selectively engageable with a hook on said second column to maintain said plae in a folded position and with the baseplate to support said plate in a rasied use position.

9. A swivel chair assembly as defined in claim 1, further including a headrest carried above said backrest in a second tube telescopically received in the longitudinal tube affixed to backrest portion.

10. A swivel chair assembly as defined in claim 1, each said armrest having an outer tube fixed to said pivotable axle and an inner tube slidable telescopically within said outer tube for selective extension thereof.

11. A swivel chair assembly as defined in claim 1, wherein each said armrest has a raised outer end opposite said pivotable axle of retaining upon said armrests a work board.

* * * * *